US005817993A

United States Patent [19]

Kamani et al.

[11] Patent Number: 5,817,993

[45] Date of Patent: Oct. 6, 1998

[54] MONITORING OF ELEVATOR DOOR REVERSAL DATA

[75] Inventors: Sanjay Kamani, Unionville; Patrick Lusaka, Windsor; Ronald R. Pepin, Windsor Locks, all of Conn.

[73] Assignee: Otis Elevator Company, Farmington, Conn.

[21] Appl. No.: 757,306

[22] Filed: Nov. 27, 1996

[51] Int. Cl.[6] ..... B66B 13/14; B66B 1/34

[52] U.S. Cl. ..... 187/316; 187/393

[58] Field of Search ..... 187/316, 391, 187/393, 317

[56] References Cited

U.S. PATENT DOCUMENTS

| | | | |
|---|---|---|---|
| 4,568,909 | 2/1986 | Whynacht | 340/21 |
| 4,622,538 | 11/1986 | Whynacht et al. | 340/506 |
| 4,750,591 | 6/1988 | Coste et al. | 187/130 |
| 4,930,604 | 6/1990 | Schienda et al. | 187/133 |
| 5,445,245 | 8/1995 | Ketoviita | 187/391 |

FOREIGN PATENT DOCUMENTS

WO 9608437 3/1996 WIPO .

OTHER PUBLICATIONS

Copy of U.S. Patent Application Ser. No. 08/738,667 entitled "Monitoring of Elevator Door Performance" filed Oct. 25, 1996, Ronald R. Pepin, et al.

Copy of U.S. Patent Application Ser. No. 08/740,601 entitled "Monitoring of Manual Elevator Door Systems" filed Oct. 31, 1996, Sanjay Kamani, et al.

*Primary Examiner*—Robert Nappi

[57] ABSTRACT

An elevator door reversal monitoring apparatus for monitoring an elevator door system comprises: a plurality of sensors for providing sensor signals; a door reversal state machine for providing door reversal data in response to the sensor signals; an output module for capturing the door reversal data; and an output processing module for determining a current state of the elevator door system in response to the captured door reversal data.

10 Claims, 2 Drawing Sheets

MONITORING OF ELEVATOR DOOR REVERSAL DATA

TECHNICAL FIELD

The present invention relates to elevator door monitoring and, more particularly, monitoring reversal data of an elevator door system.

BACKGROUND OF THE INVENTION

Elevator door systems operating at a plurality of remote sites may be monitored using sensors at the remote sites and transmitting information on the present status of a number of parameters during the systems' operation at the sites. In conventional elevator door monitoring systems, the parameters are analyzed by a signal processor so as to determine if any parameters have changed state. If so, the present value of the changed parameter is plugged into a Boolean expression defining an alarm condition in order to determine if the Boolean expression is satisfied and hence the alarm condition is present. If so, an alarm condition is transmitted and displayed as an alarm message.

DISCLOSURE OF THE INVENTION

It is an object of the present invention to provide an improved apparatus for monitoring an elevator door system.

It is a further object of the present invention to provide an apparatus which analyzes reversal data of an elevator door system.

It is another object of the present invention to provide an apparatus for distinguishing door failure information from valid passenger interaction.

In accordance with the present invention, an elevator door reversal monitoring apparatus for monitoring an elevator door system comprises: a plurality of sensors for providing sensor signals; a door reversal state machine for providing door reversal data in response to the sensor signals; an output module for capturing the door reversal data; and an output processing module for determining a condition of the elevator door system in response to the captured door reversal data.

BEST MODE FOR CARRYING OUT THE INVENTION

Figure 1:
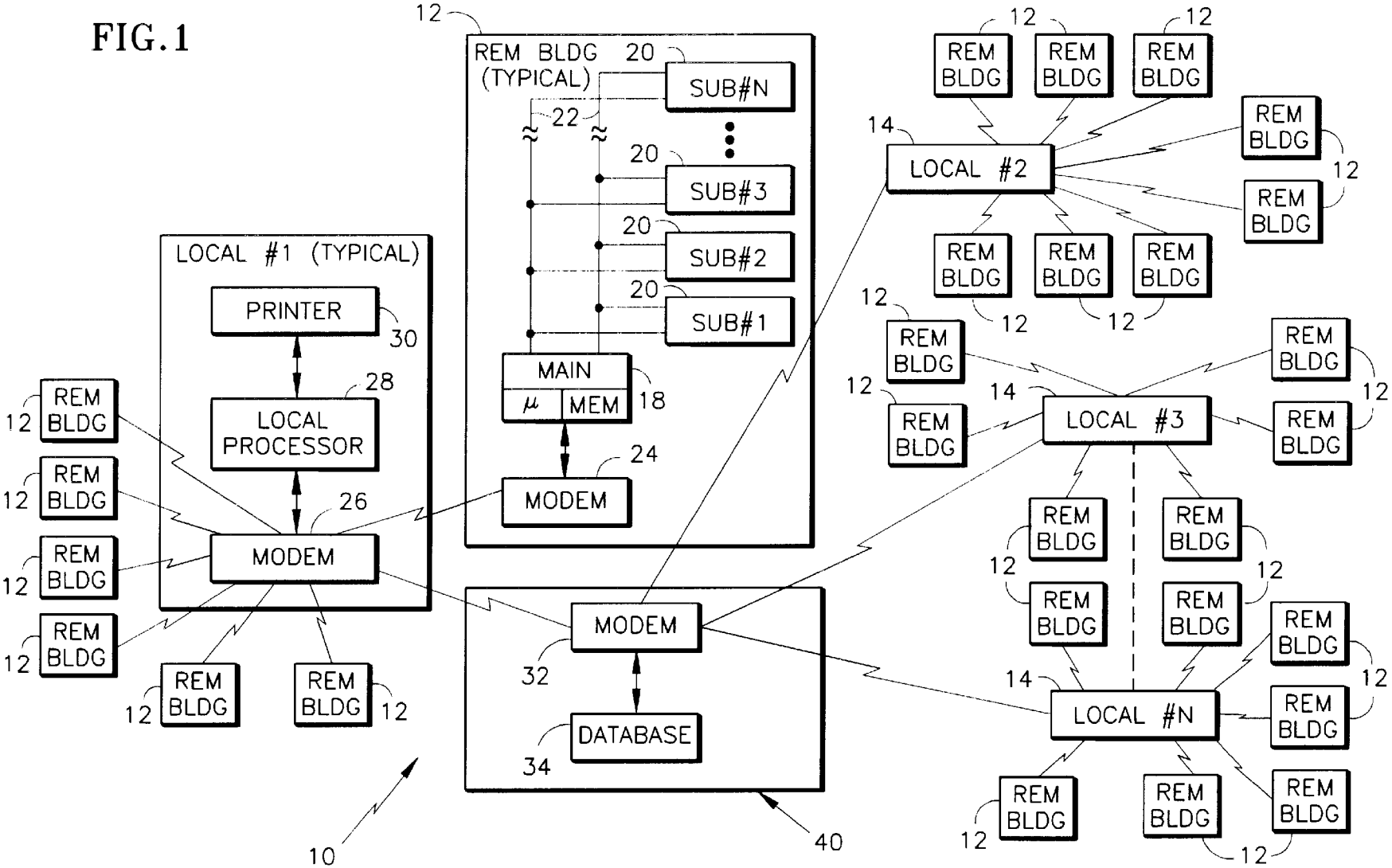
FIG. 1 is an illustration of an elevator monitoring system.

FIG. 1 illustrates a remote elevator monitoring system 10 for monitoring individual elevators in remotely located buildings 12, for transmitting alarm and performance data to associated local monitoring centers 14. The method of communication between the remote buildings and the various local offices is a bi-directional communication system whereby inoperative elevators are identified and individual elevator door performance information is transferred to a local monitoring center through the use of local telephone lines which may include radio frequency transmission paths. It should be understood that although the remote elevator monitoring system disclosed herein utilizes the public switch telephone network available within the local community in which a particular local monitoring center and its associated remote buildings are located, other equivalent forms of communication may be utilized. For example, other communication systems such as an Internet or Intranet communication system may be used with the present invention.

Each remote building of the remote elevator monitoring system includes a main 18 and one or more subordinates 20. The individual subordinates 20 are directly attached to sensors associated with an associated elevator and elevator door. The subordinates 20 transmit signals indicative of the status of selected parameters via a communication line 22 which comprises a pair of wires. The use of a two wire communications line between the main 18 and its associated subordinates 20 provides both an inexpensive means of data transmission and the ability to inexpensively dispose the main in a location remote from the subordinates. For instance, if all of the subordinates are located in the elevator machine room having a hostile environment on top of an elevator shaft, the main may be inexpensively located in a more benign environment in the building. Although the architecture of the remote elevator monitoring system within a remote building has been described as having a main communicating with one or more subordinates using an efficient two-wire communication line, it should be understood by those skilled in the art that other means of data communication and transmission including less efficient means may also be used. It should also be understood that because of the number of subordinates capable of being attached to a given communication line is finite, it may be necessary within a given remote building to utilize more than one main subordinate group.

Each main 18 includes a microprocessor which evaluates performance data according to a state machine model which is coded within the software of the microprocessor. The microprocessor through signal processors conditions the inputs provided by each subordinate 20. These inputs are then used by a state machine to determine the status of the doors as is explained herein below. As a result of the direct connection of the subordinates to the sensors, the state machine is directly responsive to the actual devices that are being monitored. Thus, any errors which may be introduced by an elevator controller are avoided. This is an advantage over conventional remote monitoring systems which are indirectly responsive to the sensors via elevator controller inputs. As the inputs are processed by the microprocessor various events and conditions are recorded and stored in the memory.

In one embodiment, each subordinate also includes a microprocessor which evaluates performance data according to a state machine model which is coded within the software of the microprocessor.

Each of the remote buildings 12 communicates with its associated local monitoring center 14 to provide alarm and performance data. More specifically, each main 18 communicates with a modem 24 which transmits alarm and performance data to a modem 26 in the associated local monitoring center 14. The local processor 28 stores the retrieved data internally and alerts local personnel as to the existence of an alarm condition and performance data useful for determining the cause of the alarm. The local processor 28 alerts local personnel of these conditions via printer 30. It should be understood that other means of communicating with local personnel, such as a CRT may as easily be used. It should be understood that although a printer and a CRT are shown for use with the invention, the use of only one of them would be sufficient. Each local processor 28 may transmit alarm and performance data via the modem 26 to another modem 32 located in a data storage unit 40. The alarm and performance data may then be stored in a database 34 for long term evaluation. Of course, it should be recognized by those skilled in the art that the present invention may be used in a variety of monitoring systems.

Figure 2:
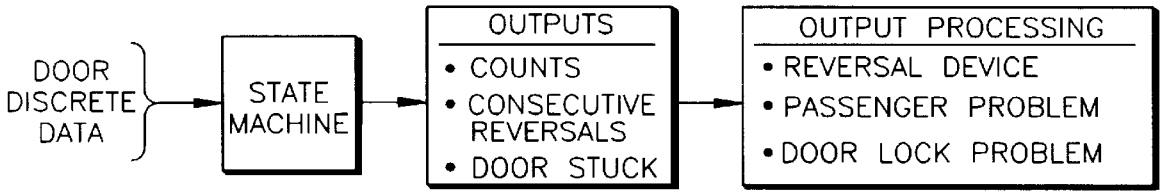
FIGS. 2 is a simplified block diagram illustrating an embodiment of door reversal diagnostic modules in accordance with the present invention.

Referring to FIG. 2, a door reversal diagnostic logic is implemented in order to capture, store, and analyze door reversal diagnostic data from the elevator door system. For purposes of simplicity, an elevator door system is described with respect to one elevator car. Thus, the elevator door system includes an elevator car door operator and its associated hoistway door assemblies at a plurality of landings in a hoistway. The door reversal diagnostic logic requires access to a number of door signals as well as other existing remote elevator monitoring signals as is described below. The door reversal diagnostic logic is separated into three modules; namely, a door reversal state machine, an output module and an output processing module.

The door reversal state machine is the core logic and algorithm that models the reversal behavior of each door system in an elevator system. If an elevator door of the door system fails to follow the normal sequence, or fails to meet the criteria for transitioning between successive states representative of normal operation, an inoperative condition or a failure condition is detected by a transition out of the normal sequence of states into an inoperative or alarm state as is explained herein below.

The output module captures reversal data for analysis. For example, the output module captures the number of each type of reversal for each door in the door system ("counts"), the number of repetitive reversals of the door system for one door cycle ("consecutive reversals") and if the door system cannot close ("door stuck"). The output module also records at which door in the door system the door reversal has occurred. These data are sent to the output processing module.

The output processing module analyzes data it receives from the output module to determine the current state of the door system. For example, the output processing module distinguishes between car door and hoistway door system failures by using historical data stored from the reversal state machine. The output processing ignores all data related to passenger reversals that are counted by counter C2.

In one embodiment, the door reversal diagnostic logic is implemented in each main 18. In another embodiment, the door reversal diagnostic logic is implemented in each main 18 and each subordinate 20. In a further embodiment, the output processing module is implemented in a monitoring center 14 and the door reversal state machine and the output module are implemented in each main 18 or in each main 18 and each subordinate 20. In another embodiment, the door reversal diagnostic logic is used as a troubleshooting logic which is downloaded to the elevator door system if a reversal problem is suspected. One skilled in the art, however, should recognize that the door reversal diagnostic logic, or any components thereof, can be implemented anywhere in the elevator monitoring system without departing from the spirit and scope of the present invention.

Figure 3:
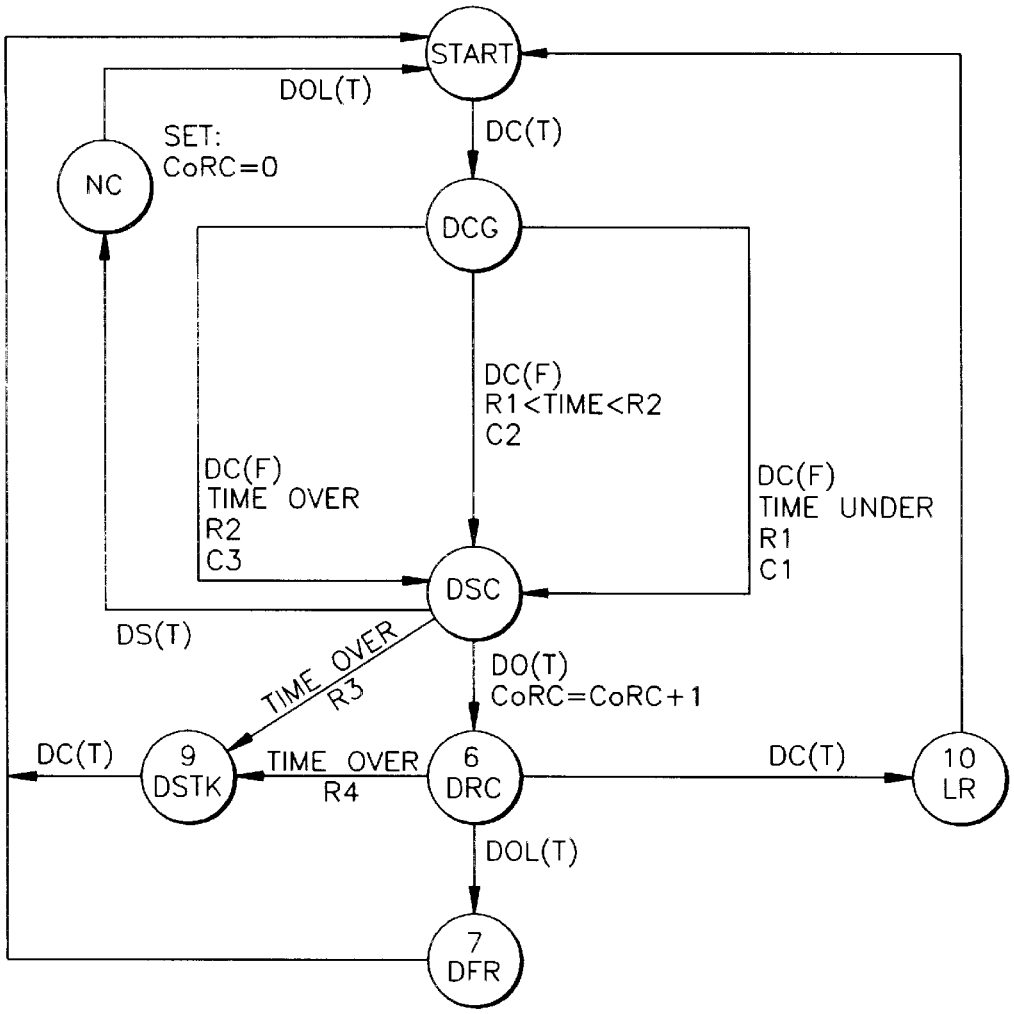
FIG. 3 is an illustration of a door reversal state machine model in accordance with an embodiment of the present invention.

Referring to FIG. 3, the door reversal state machine comprises nodes and vectors. A node is the resultant status of the door due to a sequence of events that have occurred on the door system. Each state that the elevator door can assume is represented graphically by a circle. Mnemonics used within the circle identify a state as is described herein below.

A vector is the action or path the system must take in response to a set of conditions that are presented by the inputs or some other parameter that is being monitored. Each vector has the following characteristics:

a) Goto Node -Once conditions of a vector are met the machine is updated to the new node.

b) Vector Priority -All vectors out of a node are prioritized by the vector number; the lowest number having the highest priority.

c) Vector Conditions -All vectors have the following conditions:

1) Single Input conditions -Any input could be true or false, i.e., the condition must be true before the goto vector is executed. For example, a vector can be associated to the following condition: Vi :DS(T) which means vector I will be carried out if the signal DS equals the logical value of True; Vi :DS(F) which means vector 1 will be carried out if the signal DS equals the logical value of False.

2) Multiple conditions on one vector -If multiple conditions are present for a vector, a logical "AND" of all conditions is required to update to a new node, i.e., all conditions must be true before the goto vector is executed.

d) Data Functions -Each vector is capable of outputting to the memory some output data. The output capabilities of a vector include counts which are data representing specific events such as specific state counts. Out of sequence counts are also used to track alarm states.

The door state machine models the different states of door reversal operation. Each state is a result of the previous state and a given condition (i.e. change of an input) which was achieved. The door state machine uses a plurality of door sensor signals in determining whether a condition was achieved as is explained herein below.

It should be understood that the actual hardware implementation of the state machine requires a programmer to encode all the requirements of the state machine in a particular language according to the particular hardware being used; however, the encoding details are not described because the particular hardware and programming techniques utilized are a matter of choice not embracing the inventive concept. It should be kept in mind that the state machine serves a monitoring function whereas an actual failure of the elevator is the causal factor while the detection merely serves as a monitoring function of the elevator system.

The inputs used by the door reversal state machine are shown in Table I. The mnemonics for the nodes are shown in Table II.

TABLE I

| | Description |
|---|---|
| Input Mnemonic | |
| DS | Door Switch |
| DC | Door Close Relay |
| DOL | Door Open Limit |
| DO | Door Open Relay |
| Timers | |
| R1 | Timer R1 - Mechanical Reversal Device Failure Threshold |
| R2 | Timer R2 - Average Door Close Time |
| R3 | Timer R3 - Door Stuck Timer |
| R4 | Timer R4 - Reversal Stuck Timer |

TABLE I-continued

| | Description |
|---|---|
| Counters | |
| C1 | Short Reversal Counter |
| C2 | Passenger Reversal Counter |
| C3 | Long Reversal Counter |
| CoRC | Consecutive Reversal Counter |

TABLE II

| Mnemonic | Description |
|---|---|
| START | Start Reversal Diagnostic State |
| DCG | Door Closing |
| NC | Normal Close Operation |
| DSC | Door Stopped Closing |
| DRC | Door Reopen Command |
| LR | Limited Reversals |
| DSTK | Door Stuck while reversing |
| DFR | Door Fully Reopened |

The operation of the door reversal state machine is as follows. The door reversal state machine begins operation in the start node. The state machine is in the start node whenever the doors are opening, open or closed. This start node is used for synchronizing and waiting for the door to begin closing. The door close command (DC(T) or DO(F)) command will trigger the reversal state machine to begin recording the reversal event.

Once the doors are closing, the state machine updates to the door closing node DCG and waits for the doors to stop closing DC(F). The door reversal state machine classifies the type of reversal based upon the distance the door(s) traveled before the reversal occurred. Accordingly, once the doors have stopped closing, an evaluation is made of a measured time between the start of door closing and end of door closing (door stop closing). One of three counters C1, C2, C3 is updated depending on the measured time between the start of door closing and end of door closing.

If the measured time is under a first determined time R1 then it is determined that a short reversal has occurred and a first counter C1 is updated. Short reversals can be caused by mechanical failures, passengers holding the door(s) open or passenger detection system failures. If the measured time is between the first determined time RI and a second determined time R2 then it is determined that a normal reversal occurred and a second counter C2 is updated. The C2 timer is setup to filter passenger operations related to reversals. At this point, the CoRC is also set to zero because we no longer have consecutive operation of each type of reversal. If the measured time is greater than the second determined time R2 then it is determined that a long reversal has occurred. The long reversal occurs after a normal door close time of the door(s). It should be understood that the setting of the R1 and R2 timers are chosen for each elevator and door type so the sensitivity to passenger behavior is correctly selected.

Next, the reversal state machine moves to the door stopped closing node DCS. At this node, if it is determined that the door has closed DS(T), the last counter which was previously incremented C1, C2 or C3 is decremented and a consecutive reversal counter CoRC is reset to 0. This is not a reversal but a normal door close operation. The consecutive reversal counter CoRC is used to determine the number of reversals which occur before the door closes normally. If a reopen is detected by the state machine DO(T) then the state machine is updated to the door reopen command node DRC and the consecutive reversal counter CoRC is incremented.

At the door reopen command node DRC, the state machine waits for the door to open. If the state machine detects that the door is fully open, the state machine moves to the door fully open node DFR. If the state machine does not detect that the door has fully opened after a fourth determined time R4 then it is determined that the door is stuck and the state machine is updated to the door stuck node DSTK.

If at the door reopen command node DRC, the state machine detects that the door starts closing before the full open position is achieved then it is determined that the door system is using a limited reversal feature and the state machine is updated to a limited reversal node LR. The limited reversal feature is used in some doors systems to stop reversing the doors when a reversal device, such as a obstruction detection device, indicates that the passenger or the obstruction which caused the reversal is no longer present.

If the state machine, at the door reopen command node DRC or the door stuck node DSTK, detects the DC(T) signal then it moves back to the START state.

The output processing module of the door reversal diagnostic logic analyzes reversal data in order to determine if a failure condition exists. It utilizes reversal data supplied by the reversal state machine and then observes historical reversal data captured by the output module to determine occurrence of such similar events such as long reversals (from counter C3) and short reversals (from counter C1). For all reversal data, a determination is made regarding a pattern on the same floor or over various floors on that elevator. From this it can be determined that a car door system or hoistway door system failure exists. This is performed in accordance with Table III.

TABLE III

| Failure Detected | Data Required | Determination |
|---|---|---|
| Door Lock on a specific Floor | The number of Long reversals (C3)<br>The floor number where each reversal occurred (Landing)<br>The number of consecutive reversals for each door (CoRC) | If multiple long reversals (i.e. C3 > 1 and CoRC > 0) and the floor at which the reversals occurred is the same (i.e., historical analysis shows that the multiple reversals occurred on the same floor) then the door lock on that floor has failed. |
| Car Door Gate Switch | Number of long reversals (C3)<br>The location where each reversal occurred (Landing)<br>The number of consecutive reversals for each door (CoRC) | If multiple long consecutive reversals (i.e., C3 > 1 and CoRC > 0) and historical analysis shows they occurred on various floors then an elevator car door failure exists |
| Hoistway Door System | Number of short reversals (C1)<br>The location where each reversal occurred (Landing)<br>The number of consecutive reversals for each door (CoRC) | If multiple short consecutive reversals (i.e., C1 > 2 and CoRC > 0) and historical analysis shows they occur on the same floor; then the hoistway door system has degraded |
| Car Door Reversal Device | Number of short reversals (C1)<br>The location where each reversal occurred (Landing)<br>The number of consecutive reversals for each door (CoRC) | If multiple short consecutive reversals (i.e., C1 > 2 and CoRC > 0) and historical analysis shows they occur on the various floors of the same elevator; then the passenger detection system has degraded |
| Car Door System | Number of short reversals (C1) | If multiple short consecutive reversals (i.e., C1 > 2 and |

TABLE III-continued

| Failure Detected | Data Required | Determination |
|---|---|---|
| | Number of Long reversals (C3) The location where each reversal occurred (Landing) The number of consecutive reversals for each door (CoRC) | CoRC > 0) and multiple long consecutive reversals occur and historical analysis shows they both occur on the various floors of the same elevator; then the car door system has degraded |
| Door Failed | Door stuck (DSTK) | The elevator doors are stuck. This is a general Door System Failure |

The present invention has the advantage of providing detailed door reversal data which can be trended or simply used as a performance indicator. For example, if a conventional remote monitoring system reported an elevator shutdown via an inoperative signal, the basic information which was conveyed is that the door was unable to close in response to a command to close signal. However, the present invention provides detailed information concerning the reversals on all floors. Embedded in the output processing section of the door reversal diagnostic data is logic that will perform automatic historical analysis whenever a reversal event is reported. This historical analysis looks for the occurrence (short or long consecutive reversals) over a determined period of time; in one embodiment, the determined period of time is one week. Once it has been established that a condition is detected over the determined period of time, an analysis of the distribution of where in the building this condition was detected is made. If the condition is detected only on one floor then the determination is made the failure is related to that specific floor such as a hoistway door failure. If the condition is detected on a plurality of floors then it is determined that the failure is not related to a specific floor but instead is related to the elevator car; i.e., the car door. The above mentioned determinations are possible because passenger interaction noise is removed by the Passenger Counter C2. This allows for only consistent non-random patterns to be stored in memory. Passenger behavior is generally random and inconsistent as compared to elevator door operation.

Various changes to the above description may be made without departing from the spirit and scope of the present invention as would be obvious to one of ordinary skill in the art of the present invention.

What is claimed is:

1. An elevator door closing reversal monitoring apparatus for monitoring an elevator door system, said apparatus comprising:

a plurality of sensors for providing sensor signals;

a door closing reversal state machine for providing door closing reversal data in response to the sensor signals, said data including a time measurement between a start of door closing and an end of door closing. without regard to the position of the door when door closing stops;

an output module for capturing the door reversal data; and an output processing module for determining a condition of the elevator door system in response to the captured door reversal data, wherein said door reversal state machine classifies each door reversal in response to said time measurement.

2. An elevator door reversal monitoring apparatus as recited in claim 1 wherein each door reversal is classified in accordance with a plurality of door reversal types.

3. An elevator door reversal monitoring apparatus as recited in claim 2 wherein said plurality of door reversal types comprise a short reversal, a long reversal and a passenger reversal.

4. An elevator door reversal monitoring apparatus as recited in claim 1 wherein a number of consecutive reversals of the elevator door system is determined.

5. An elevator door reversal monitoring apparatus as recited in claim 1 wherein said output processing module ignores door reversal data caused by passenger interaction.

6. An elevator door reversal monitoring apparatus as recited in claim 1 wherein said output processing module determines that a hoistway door lock failure condition exists if multiple long reversals occur at a single landing associated with the elevator door system.

7. An elevator door reversal monitoring apparatus as recited in claim 1 wherein said output processing module determines that an elevator car door failure condition exists if multiple long reversals occur on a plurality of landings associated with the elevator door system.

8. An elevator door reversal monitoring apparatus as recited in claim 1 wherein said output processing module determines that a hoistway door system degradation condition exists if multiple short reversals occur on a single landing associated with the elevator door system.

9. An elevator door reversal monitoring apparatus as recited in claim 1 wherein said output processing module determines that a passenger detection system degradation condition exists if multiple short reversals occur on a plurality of landings associated with the elevator door system.

10. An elevator door reversal monitoring apparatus as recited in claim 1 wherein said output processing module determines that a car door system degradation condition exists if multiple long reversals and multiple short reversals occur on a plurality of landings associated with the elevator door.

* * * * *